US007073211B1

(12) United States Patent
Wu

(10) Patent No.: US 7,073,211 B1
(45) Date of Patent: Jul. 11, 2006

(54) HYDRAULIC PLUMBER'S FRIEND

(75) Inventor: Kuei-Kun Wu, Kaohsiung (TW)

(73) Assignee: Sam Rock Industrial Co., Ltd., Kaohsiung (TW)

( * ) Notice: Subject to any disclaimer, the term of this patent is extended or adjusted under 35 U.S.C. 154(b) by 0 days.

(21) Appl. No.: 11/303,078

(22) Filed: Dec. 14, 2005

(51) Int. Cl.
*E03D 9/00* (2006.01)

(52) U.S. Cl. ..... 4/255.02; 4/255.01; 4/255.11

(58) Field of Classification Search ... 4/255.01–255.11
See application file for complete search history.

(56) References Cited

U.S. PATENT DOCUMENTS 3,934,280 A * 1/1976 Tancredi ..... 4/255.02
4,186,451 A * 2/1980 Ruo ..... 4/255.02
4,847,923 A * 7/1989 Huang ..... 4/255.03
5,199,114 A * 4/1993 Christopher ..... 4/255.02
5,522,094 A * 6/1996 Balazs ..... 4/255.02
5,823,754 A * 10/1998 Lee ..... 4/255.08
5,927,957 A * 7/1999 Kennedy et al. ..... 417/511
6,499,151 B1 * 12/2002 Ollinger ..... 4/255.02

* cited by examiner

*Primary Examiner*—Tuan Nguyen
(74) *Attorney, Agent, or Firm*—Alan D. Kamrath; Nikolai & Mersereau, P.A.

(57) ABSTRACT

A hydraulic plumber's friend has a cylindrical body, a lid, a compression assembly, a tapered end cap and a nozzle assembly. The cylindrical body has an open bottom and holds water to be injected into a clogged pipe. The compression assembly has a drive shaft and a piston mounted slidably in the cylindrical body. The tapered end cap is mounted on the open bottom of the cylindrical body and has a transverse partition, a tapered body and a spout. The nozzle assembly has a valve having a cylindrical disk mounted slidably in the spout and having a closed top, an open bottom, a cylindrical sidewall and multiple charging holes, a valve stem and a spring. When the charging holes are uncovered, water flows. The nozzle is mounted on the cylindrical disk and seals and directs water into an opening in a clogged pipe.

18 Claims, 8 Drawing Sheets

HYDRAULIC PLUMBER'S FRIEND

BACKGROUND OF THE INVENTION

1. Field of the Invention

The present invention relates to a plumber's friend, and more particular to a hydraulic plumber's friend to remove obstructions from pipes with hydraulic pressure.

2. Description of the Related Art

A conventional plumber's friend in accordance with the prior art has a resilient cup and a handle. The resilient cup has a closed top and an open bottom. The handle is attached to the closed top of the resilient cup. When a pipe is obstructed, the open bottom of the resilient cup is pressed against an opening of the pipe, and the handle is pushed back to press air in the resilient cup into the pipe and shock and dislodge an obstruction. However, air has a high compression ratio, which keeps the conventional plumber's friend from being vely effective.

With reference to FIG. 8, a conventional hydraulic plumber's friend in accordance with the prior art is connected to an external water source through an extension hose (100) and comprises a resilient cup (81), a T-shaped nozzle (not numbered) and a trigger (90).

The resilient cup (81) covers an opening in a pipe to be unclogged by the hydraulic plumber's friend and has an open bottom (not numbered), a top (numbered) and a through hole (811). The open bottom covers the opening in a pipe to be unclogged. The through hole (811) is defined through the top of the resilient cup (81).

The T-shaped nozzle connects to the external water source with the extension hose (100) and comprises a nozzle (82), a bonnet (83), a disk assembly (not numbered) and an inlet tube (84).

The nozzle (82) has a proximal end (not numbered) and a distal end (not numbered). The distal end of the nozzle (82) is mounted in the through hole (811) of the resilient cup (81). The proximal end of the nozzle (82) serves as a valve seat (not numbered).

The bonnet (83) is cylindrical and has an open bottom (not numbered), a top (not numbered), a sidewall (not numbered), a stem hole (831) and an inlet hole (832). The open bottom of the bonnet (83) is connected to the distal end of the nozzle (82). The stem hole (831) is defined through the top of the bonnet (83). The inlet hole (832) is defined through the sidewall of the bonnet (83).

The disk assembly is mounted slidably in the bonnet (83) and comprises a stem (93), a disk (931) and a spring (94).

The stem (93) is slidably mounted in the stem hole (831) in the top of the bonnet (83) and has a distal end (not numbered), a proximal end (not numbered) and an enlarged end cap (932). The enlarged end cap (932) is formed on the proximal end of the stem (93).

The disk (931) is connected to the distal end of the stem (93) and is pressed against and closes the proximal end of the nozzle (82).

The spring (94) is mounted around the stem (93) between the disk (931) and the top of the bonnet (83) to press the disk (931) against the proximal end of the nozzle (82) in a default situation.

The input tube (84) has a proximal end (not numbered), a distal end (not numbered) and an external surface (not numbered). The proximal end of the input tube (84) is mounted in the inlet hole (832) in the bonnet (83). The distal end of the input tube (84) is connected to an external water source with an extension hose (100).

The trigger (90) is connected to the stem (93), opens the proximal end of the nozzle (82) to allow water to flow through the nozzle (82) and has a bracket (91) and a handle (92). The bracket (91) is mounted on and protrudes from the external surface of the input tube (84) and aligns with the stem (93) protruding from the top of the bonnet (83). The handle (92) is mounted pivotally in the bracket (91) and has a proximal end (not numbered) and a distal end (not numbered). The proximal end is mounted around the stem (93) between the top of the bonnet (83) and the enlarged end cap (932) and has a through hole (not numbered). The through hole is smaller than the enlarged end cap (932), and the enlarged end cap (932) is retained above the proximal end of the handle (92). Depressing the distal end of the handle (92) causes the proximal end of the handle (92) to lift the enlarged end cap (932) and the stem (93) and lifts the disk (931) away from the proximal end of the nozzle (82) and allows water to flow through the nozzle (82). When the distal end of the handle (92) is released, the spring (94) presses the disk (931) against the proximal end of the nozzle (82).

The conventional hydraulic plumber's friend uses water to dislodge obstructions in a pipe because water cannot be compressed. However, the conventional hydraulic plumber's friend must be connected to an external water source, which may not be convenient. Further, the resilient cup (81) does not seal an opening in a pipe tightly, and water will spray from under the open bottom of the resilient cup (81) when the proximal end of the nozzle (82) is opened.

SUMMARY OF THE INVENTION

The primary objective of the present invention is to provide a hydraulic plumber's friend to remove obstructions in a pipe, which does not have to be connected to an external water source.

The hydraulic plumber's friend in accordance with the present invention comprises a cylindrical body, a lid, a compression assembly, a tapered end cap and a nozzle assembly.

The cylindrical body has an open top and an open bottom and holds water to be injected into a clogged pipe.

The lid is mounted on the open top of the cylindrical body.

The compression assembly has a drive shaft mounted slidably through the lid and a piston mounted slidably in the cylindrical body to pressurize water in the cylindrical body.

The tapered end cap is mounted on and covers the open bottom of the cylindrical body and has a transverse partition, a tapered body and a spout. The transverse partition is attached to the open bottom of the cylindrical body and has multiple through holes. The through holes allow water can flow through the through holes so water can be poured into and discharged from the cylindrical body. The tapered body extends from the transverse partition The spout extends down from the tapered body.

The nozzle assembly is mounted slidably in the tapered end cap, controls water poured into and discharged from the cylindrical body and has a valve and a nozzle. The valve is mounted slidably in the spout and through the transverse partition and has a cylindrical disk, a valve stem and a spring. The cylindrical disk is mounted slidably in the spout and has a closed top, an open bottom, a cylindrical sidewall and multiple charging holes defined through the cylindrical sidewall. When the cylindrical disk moves up, the charging holes are uncovered and allow water to flow. The nozzle is mounted on the cylindrical disk, seals and directs water into an opening in a clogged pipe and has a discharge hole. The hydraulic plumber's friend in accordance with the present invention does not need to be connected to an external water source because water can be poured into the cylindrical body and stored. The present invention is more convenient to use in locations with no external water sources.

DETAILED DESCRIPTION OF THE PREFERRED EMBODIMENT

Figure 1:
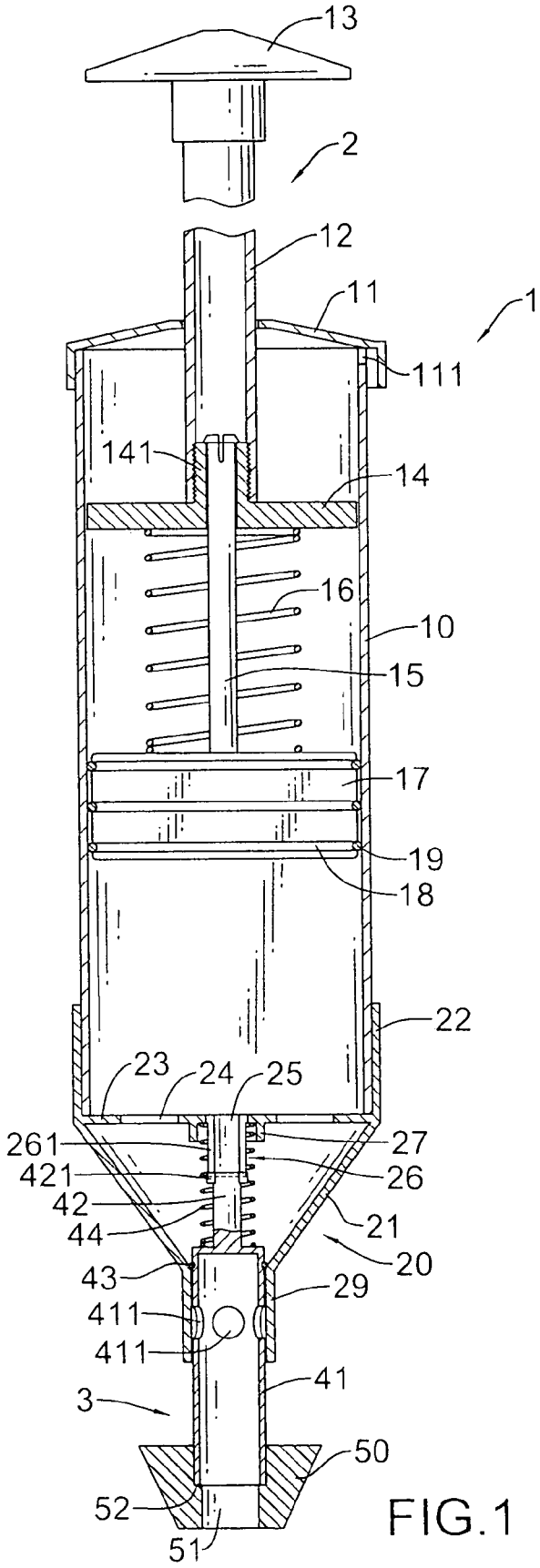
FIG. 1 is a side view in partial section of a first embodiment of a hydraulic plumber's friend in accordance with the present invention.
Figure 2:
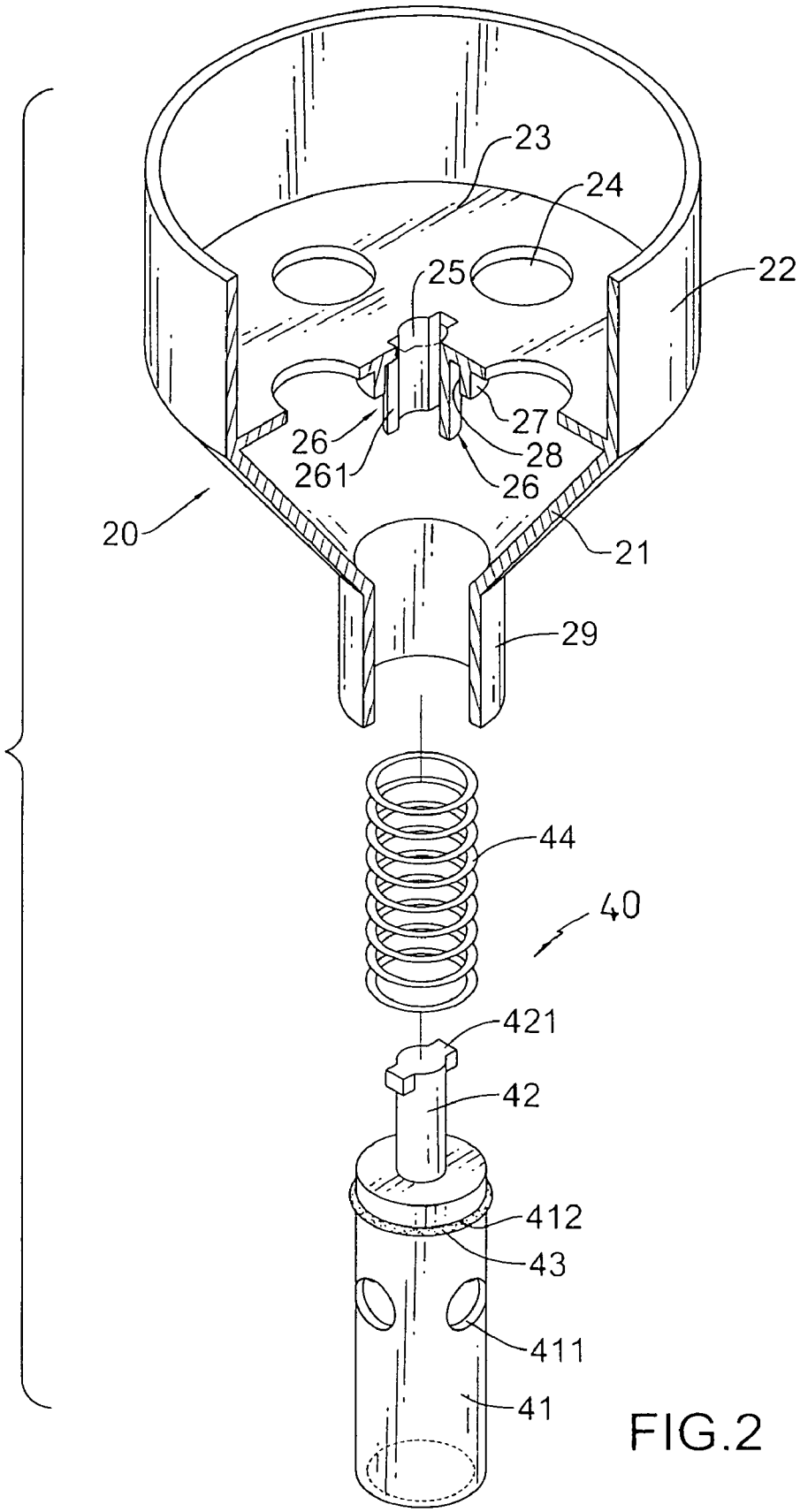
FIG. 2 is an enlarged exploded perspective view in partial section of a tapered end cap and part of a nozzle assembly of the hydraulic plumber's friend in FIG. 1.
Figure 7:
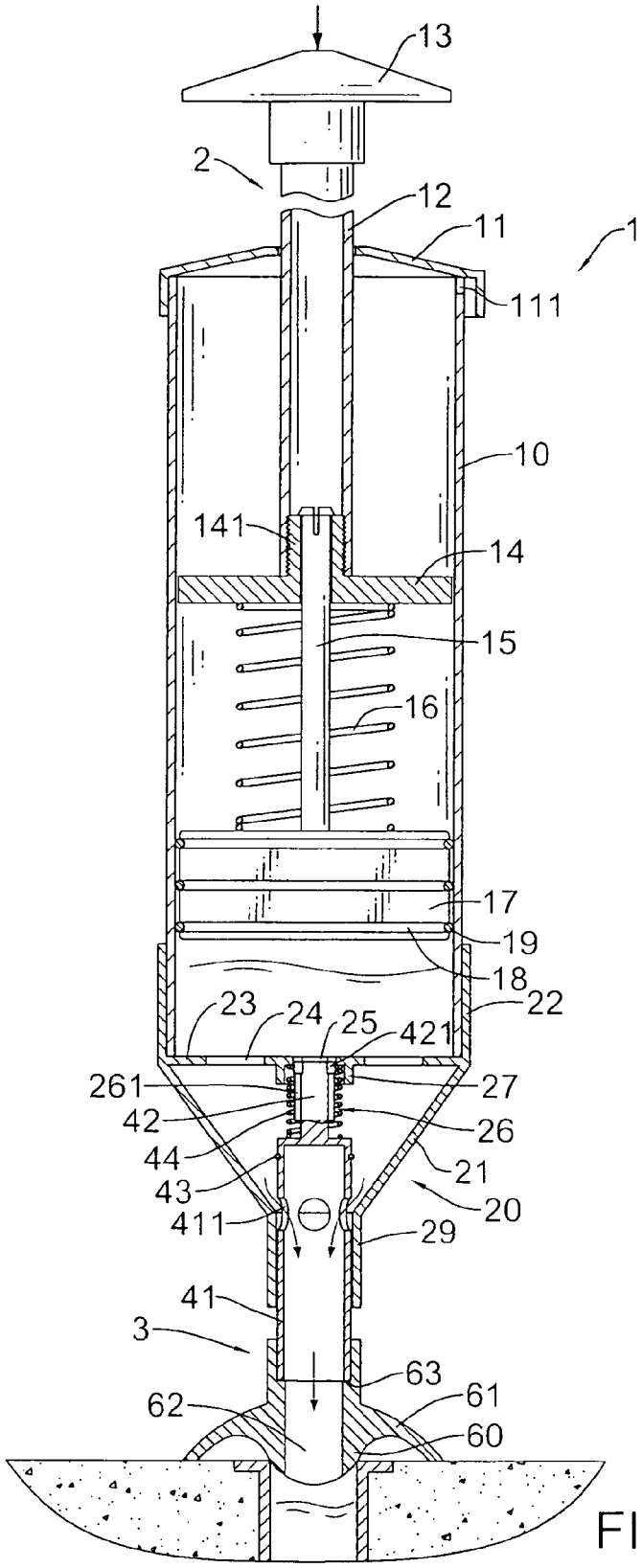
FIG. 7 is an operational side view in partial section of a second embodiment of the hydraulic plumber's friend in accordance with the present invention.
Figure 8:
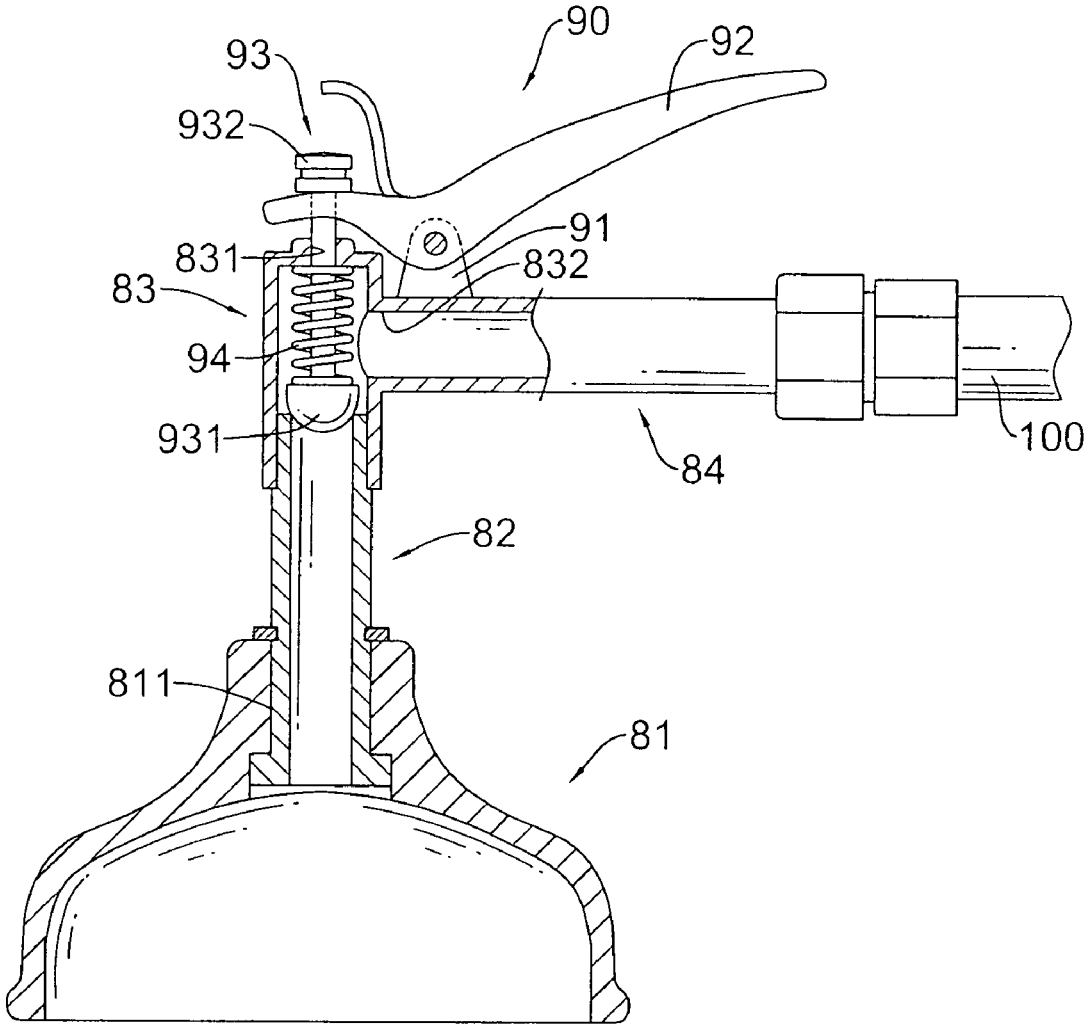
FIG.8 PRIOR ART
FIG. 8 is a side view in partial section of a conventional hydraulic plumber's friend in accordance with the prior art.

With reference to FIGS. 1, 2 and 7, a hydraulic plumber's friend (1) in accordance with the present invention comprises a cylindrical body (10), a lid (11), a compression assembly (2), a tapered end cap (20) and a nozzle assembly (3).

The cylindrical body (10) has an open top, a top edge, an open bottom and an optional notch (111). The notch (111) is defined in the top edge of the cylindrical body (10) and allows air pressure inside the cylindrical body (10) to instantaneously equalize with ambient air pressure.

The lid (11) is mounted on and covers the open top of the cylindrical body (10) and has a central through hole.

The compression assembly (2) increases hydraulic pressure of water in the cylindrical body (10) prior to release of the water into a clogged pipe and is mounted slidably in the cylindrical body (10) and has a piston (17), a piston rod (15), a stabilizer (14), a spring (16), a drive shaft (12) and an optional knob (13).

The piston (17) is mounted slidably in the cylindrical body (10) and has a top, a cylindrical surface, multiple optional annular grooves (18) and multiple optional O-rings (19). The annular grooves (18) are defined around the cylindrical surface of the piston (17). The O-rings (19) are mounted respectively in the annular grooves (18) and abut the cylindrical body (10) to keep water from leaking through any gap between the piston (17) and the cylindrical body (10).

The piston rod (15) has a proximal end, a distal end and a retaining cap. The proximal end of the piston rod (15) is attached coaxially to the top of the piston (17). The retaining cap is formed on and protrudes radially out from the distal end of the piston rod (15).

The stabilizer (14) is mounted slidably in the cylindrical body (10) and has a top, a center, an outer edge, an optional nipple (141) and an axial hole. The outer edge slides against the cylindrical body (10) and keeps the stabilizer (14) centered. The nipple (141) is formed coaxially on the top of the stabilizer (14) and has a center, an outer surface and an external thread. The external thread is formed on the outer surface. The axial hole is formed through the center of the stabilizer (14) and the nipple (141), is slightly larger than the piston rod (15), is smaller than the retaining cap on the distal end of the piston rod (15), is slidably mounted around the piston rod (15) and keeps the retaining cap and the piston rod (15) from sliding out of the stabilizer (14).

The spring (16) is mounted around the piston rod (15) between the piston (17) and the stabilizer (14).

Figure 5:
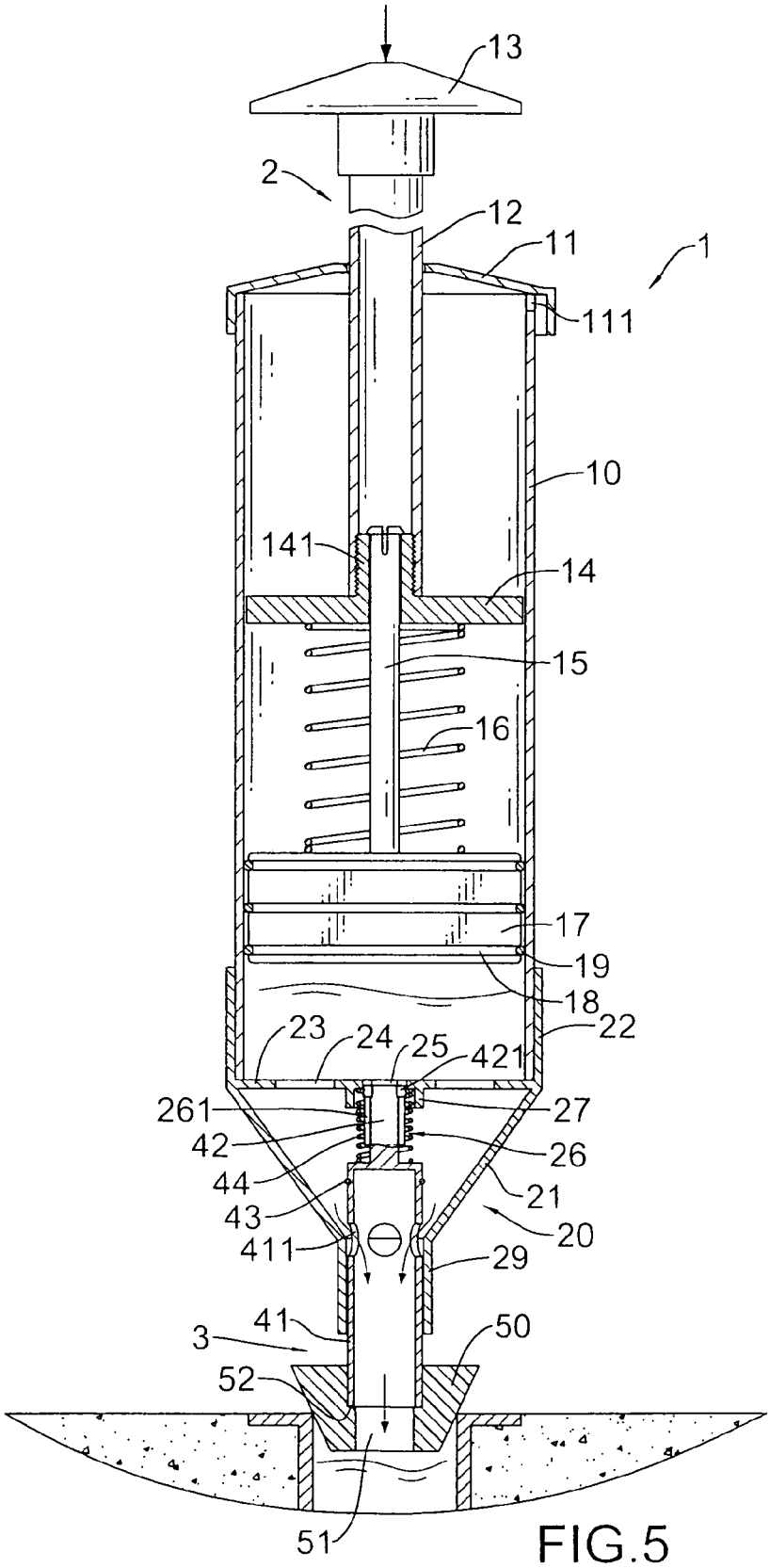
FIG. 5 is an operational side view in partial section of the hydraulic plumber's friend in FIG. 1 with the nozzle assembly inserted into an opening in a pipe.
Figure 6:
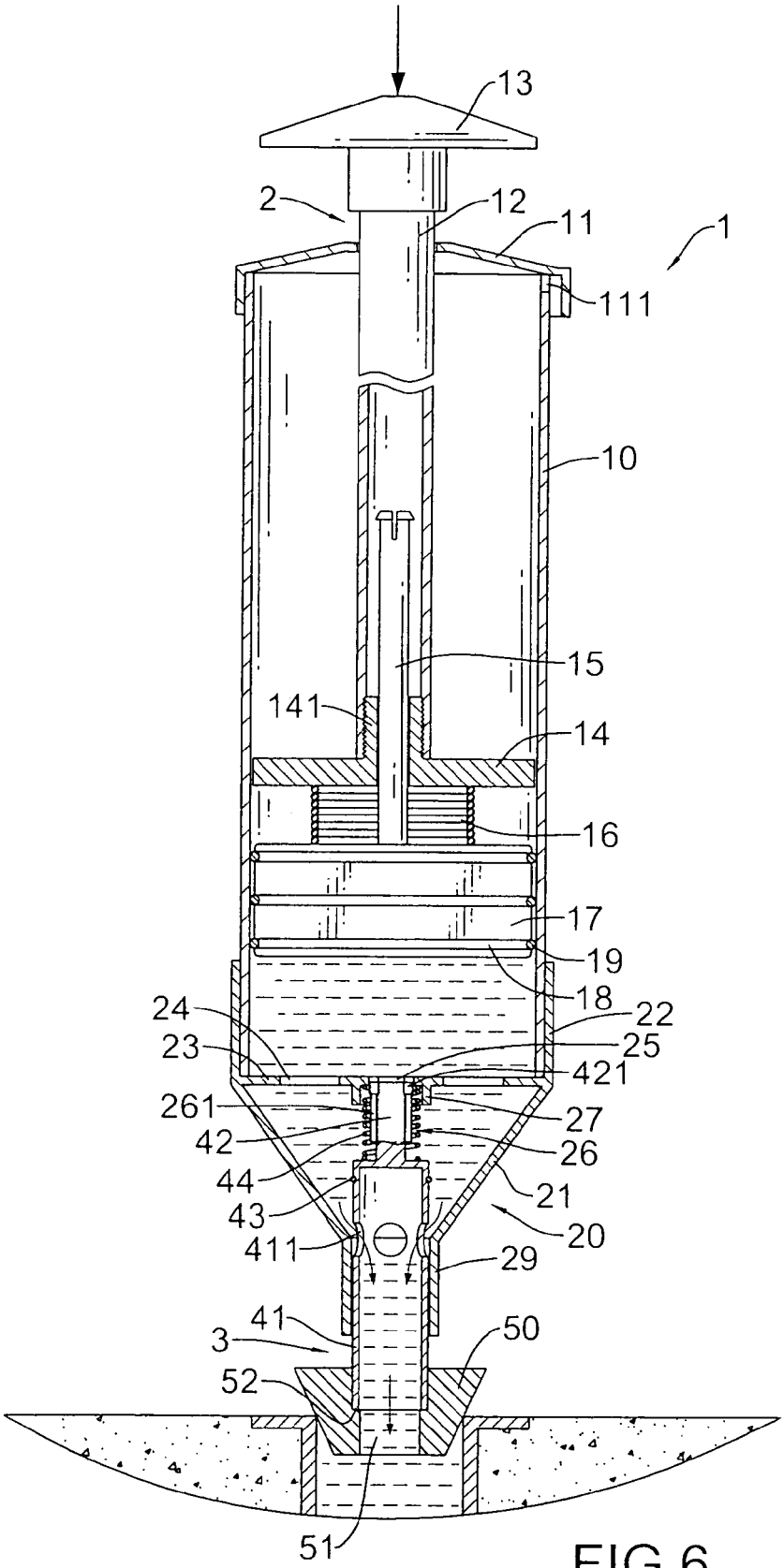
FIG. 6 is an operational side view in partial section of the hydraulic plumber's friend in FIG. 1 with a compression assembly of the hydraulic plumber's friend depressed.

The drive shaft (12) is tubular, is mounted slidably through the central through hole in the lid (11) and has a proximal end, a distal end an inside surface and an optional inner thread. The proximal end of the drive shaft (12) is attached coaxially to the top in the stabilizer (14) around the axial hole of the stabilizer (14). The inner thread is formed on the inside surface at the proximal end of the drive shaft (12) and screws onto the outer thread on the nipple (141) of the stabilizer (14) to attach the drive shaft (12) to the stabilizer (14). With further reference to FIGS. 5 and 6, pressing the drive shaft (12) into the cylindrical body (10) causes the stabilizer (14) to slide along the piston rod (15) and compress the spring (16) and presses the piston (17) against water in the cylindrical body (10).

The knob (13) is attached to the distal end of the drive shaft (12) and makes depressing the drive shaft (12) easier.

The tapered end cap (20) is mounted on and covers the open bottom of the cylindrical body (10) and has a transverse partition (23), a tapered body (21), a spout (29) and an optional extended rim (22).

The transverse partition (23) is attached to the open bottom of the cylindrical body (10) and has a center, an inner surface, an outer surface, a keyed hole (25), two optional curved inner tabs (26), an optional spring flange (27), multiple through holes (24) and an outer edge.

The keyed hole (25) is defined through the center of the transverse partition (23) and has an inner edge.

The curved inner tabs (26) are formed on the outer surface of the transverse partition, extend down from the inner edge of the keyed hole (25) and form two keyways (261). Each curved inner tab (26) has two ends. The keyways (261) are formed respectively between corresponding ends of the curved inner tabs (26).

The spring flange (27) is formed on and extends down from the outer surface of the transverse partition (23) coaxially around the curved inner tabs (26) and forms a spring mounting groove (28) between the spring flange (27) and the curved inner tabs (26).

The through holes (24) are defined through the transverse partition (23) around the keyed hole (25).

The tapered body (21) is hollow, connects to and extends down from the outer edge of the transverse partition (23) and has an open bottom. The open bottom has an edge.

The spout (29) is cylindrical and connects to and extends down from the open bottom of the tapered body (21).

The extended rim (22) is cylindrical, connects to and extends up from the outer edge of the transverse partition (23) and presses against the cylindrical body (10) to form a watertight seal.

The nozzle assembly (3) selectively opens or closes the open bottom of the tapered body (21) of the tapered end cap (20), directs pressurized water into an opening in a clogged pipe, is mounted slidably in the tapered end cap (20) and has a valve (40) and a nozzle (50, 60).

The valve (40) is mounted slidably in the spout (29) and the keyed hole (25) in the transverse partition (23) and has a cylindrical disk (41), a valve stem (42), an optional O-ring (43) and a spring (44).

The cylindrical disk (41) is mounted slidably in the spout (29), selectively opens and closes the valve (40) to hold water in or release water from the cylindrical body (10) and has a closed top, an open bottom, a cylindrical sidewall, multiple charging holes (411) and an optional annular groove (412). The cylindrical sidewall has an outer surface. The multiple charging holes (411) are defined through the cylindrical sidewall of the cylindrical disk (41). The annular groove (412) is defined in the outer surface of the cylindrical sidewall around the cylindrical sidewall between the charging holes (411) and the closed top of the cylindrical disk (41).

Figure 3:
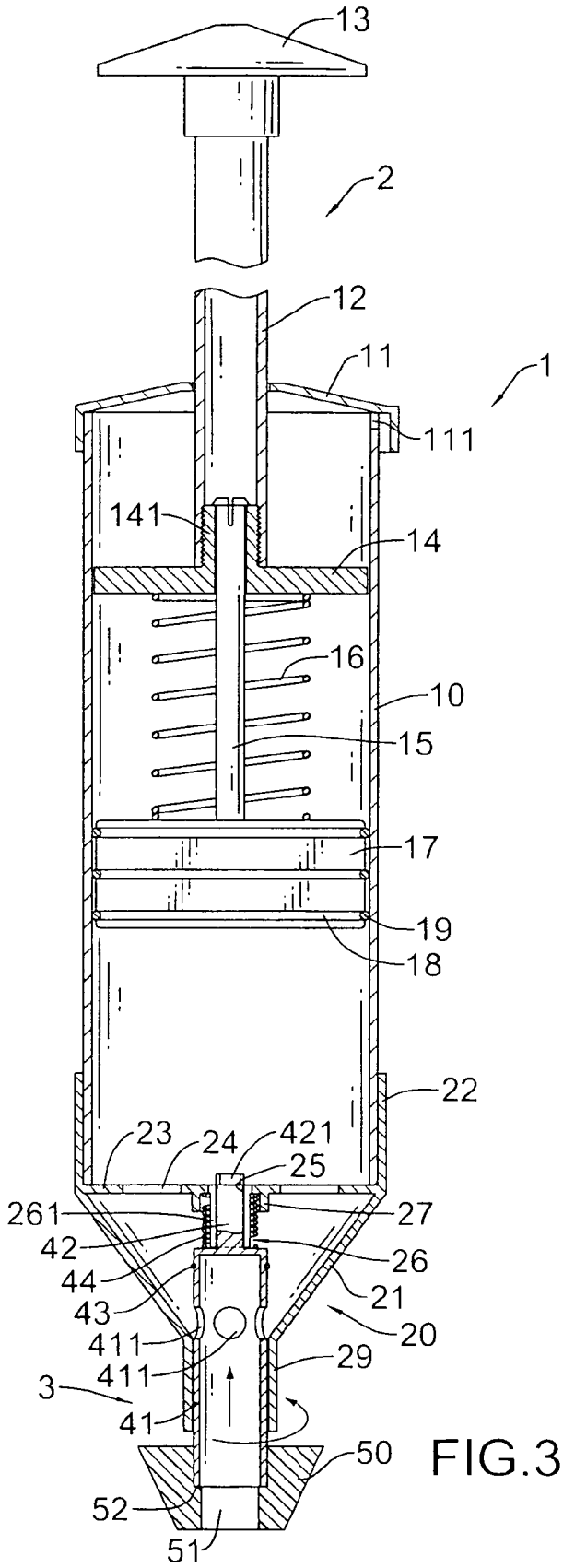
FIG. 3 is an operational side view in partial section of the hydraulic plumber's friend in FIG. 1 with the nozzle assembly pressed into the tapered end cap.
Figure 4:
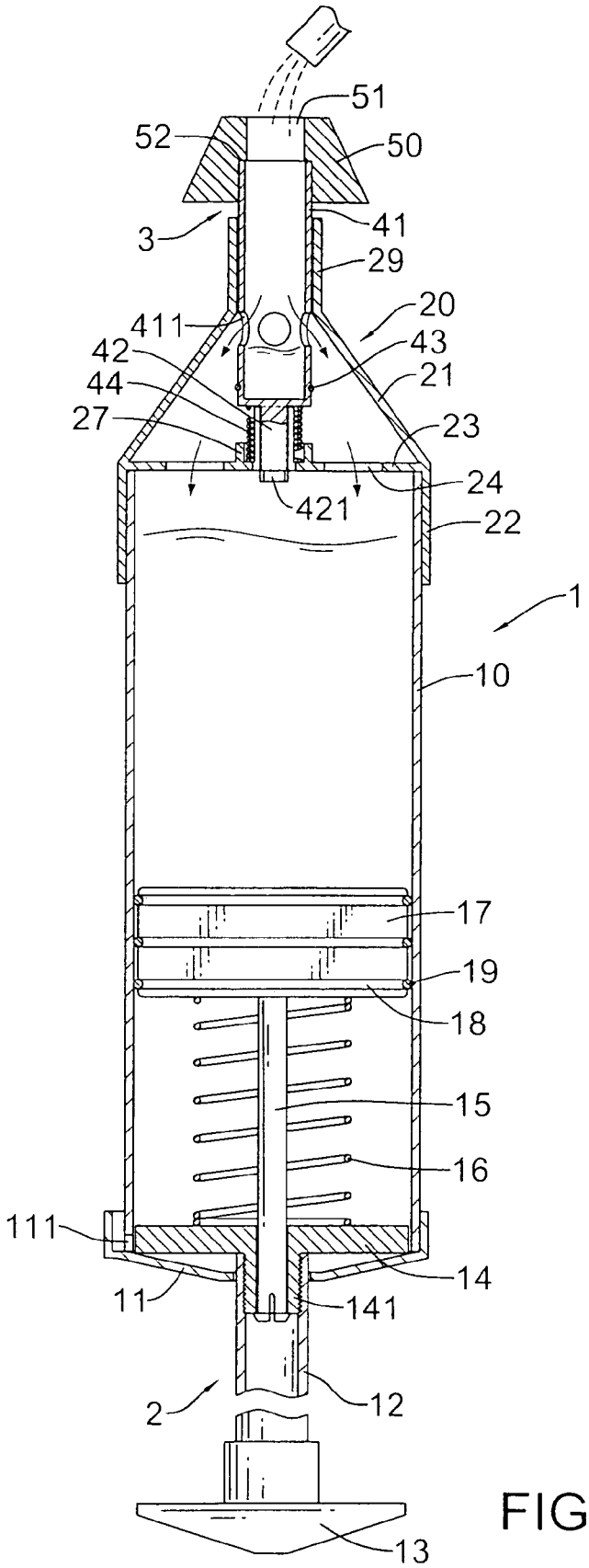
FIG. 4 is an operational side view in partial section of the hydraulic plumber's friend in FIG. 1 with water being poured into the hydraulic plumber's friend.

The valve stem (42) connects coaxially to and extends up from the closed top of the cylindrical disk (41), is mounted through and protrudes from the keyed hole (25) in the transverse partition (23) and has a distal end and a locking key (421). With further reference to FIG. 3, the locking key (421) is formed on and protrudes radially out from the distal end of the valve stem (42), is mounted slidably through the keyed hole (25) in the transverse partition (23) and latches onto the inner surface of the transverse partition (23) when the valve stem (42) is rotated to keep the valve stem (42) from sliding out of the keyed hole (25). When the locking key (421) abuts the inner surface of the transverse partition (23), the spout (29) does not block the charging holes (411) and allow water in the cylindrical body (10) flowing out of the open bottom of the cylindrical disk (41). With further reference to FIG. 4, inverting the hydraulic plumber's friend (1) and pressing the valve (40) into the spout (29) exposes the charging holes (411) in the cylindrical disk (41) and allows water to be poured into and fill the cylindrical body (10) between the piston (17) and the spout (29). With further reference to FIG. 5, water is released from the cylindrical body (10) and injected into a clogged pipe when the valve (40) is pressed into the tapered body (21) and exposes the charging holes (411).

The O-ring (43) is mounted in the annular groove (412) in the cylindrical disk (41) and forms a watertight seal between the cylindrical disk (41) and the spout (29) to prevent water from leaking out of the tapered end cap (20).

The spring (44) is mounted around the valve stem (42) between the closed top of the cylindrical disk (41) and the transverse partition (23) and has a proximal end and a distal end. The proximal end of the spring (30) presses against the outer surface of the transverse partition (23) and is mounted in the spring mounting groove (28). The distal end of the spring (44) presses against the closed top of the cylindrical disk (41) and holds the charging holes (411) and the O-ring (43) inside the spout (29).

With further reference to FIG. 7, the nozzle (50, 60) is a resilient material, 2 is attached to the open bottom of the cylindrical disk (41) of the valve (40), forms a seal with an opening in a clogged pipe and has an exterior surface, a discharge hole (51, 62), an optional mounting shoulder (52, 63) and an optional splash shield (61). The discharge hole (51, 62) is formed coaxially through the nozzle (50, 60), mounted around the open bottom of the cylindrical disk (41), directs water flowing from the cylindrical disk (41) of the valve (40) into an opening in a clogged pipe and has an interior surface. The mounting shoulder (52, 63) is defined on the interior surface of the discharge hole (51, 62) and abuts the open bottom of the cylindrical disk (41) to keep the nozzle (50, 60) from sliding up on the cylindrical disk (41) when the drive shaft (12) of the compression assembly (2) is pressed into the cylindrical body (10) and compresses the spring (16) around the piston rod (15) and presses the piston (17) against the water in the cylindrical body (10). The splash shield (61) is formed around and extends out and down from the exterior surface of the nozzle (60) to keep water escaping from an opening in a clogged pipe from splashing over a large area.

The hydraulic plumber's friend in accordance with the present invention does not need to be connected to an external water source and is convenient to use virtually anywhere.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hydraulic plumber's friend comprising:

a cylindrical body having
- an open top;
- a top edge; and
- an open bottom;

a lid mounted on and covering the open top of the cylindrical body and having a central through hole;

a compression assembly mounted slidably in the cylindrical body to increase hydraulic pressure of water in the cylindrical body prior to release of the water and having
- a piston mounted slidably in the cylindrical body and having
  - a top; and
  - a cylindrical surface;
- a piston rod having
  - a proximal end attached coaxially to the top of the piston;
  - a distal end; and
  - a retaining cap formed on and protrudes radially out from the distal end of the piston rod;
- a stabilizer mounted slidably in the cylindrical body and having
  - a top;
  - a center;
  - an outer edge sliding against the cylindrical body and keeping the stabilizer centered; and
  - an axial hole formed through the center of the stabilizer and slidably mounted around the piston rod to keep the retaining cap and the piston rod from sliding out of the stabilizer;
- a spring mounted around the piston rod between the piston and the stabilizer; and
- a drive shaft being tubular, mounted slidably through the central through hole in the lid and having
  - a proximal end attached coaxially to the top of the stabilizer around the axial hole in the stabilizer;
  - a distal end; and
  - an inside surface;

a tapered end cap mounted on and covering the open bottom of the cylindrical body and having
- a transverse partition attached to the open bottom of the cylindrical body and having a center;
an inner surface;
an outer surface;
a keyed hole defined through the center of the transverse partition and having an inner edge;
multiple through holes defined through the transverse partition around the keyed hole; and
an outer edge;
a tapered body being hollow, connecting to and extending down from the outer edge of the transverse partition and having an open bottom; and
a spout being cylindrical and connecting to and extending down from the open bottom of the tapered body; and
a nozzle assembly mounted slidably in the tapered end cap for selectively opening and closing the open bottom of the tapered body of the tapered end cap and directing pressurized water into an opening in a clogged pipe and having
a valve mounted slid ably in the spout and the keyed hole in the transverse partition and having
a cylindrical disk mounted slidably in the spout for selectively opening and closing the valve to hold water in or release water from the cylindrical body and having
a closed top;
an open bottom;
a cylindrical sidewall having an outer surface; and
multiple charging holes defined through the cylindrical sidewall of the cylindrical disk;
a valve stem connecting coaxially to and extending up from the closed top of the cylindrical disk, mounted through and protruding from the keyed hole in the transverse partition and having
a distal end; and
a locking key formed on and protruding radially out from the distal end of the valve stem, mounted slidably through the keyed hole in the transverse partition and latching onto the inner surface of the transverse partition;
a spring mounted around the valve stem between the closed top of the cylindrical disk and the transverse partition of the tapered end cap, and having
a proximal end pressing against the outer surface of the transverse partition; and
a distal end pressing against the closed top of the cylindrical disk and holding the charging holes inside the spout; and
a nozzle being a resilient material, attached to the open bottom of the cylindrical disk of the valve and having
an exterior surface; and
a discharge hole formed coaxially through the nozzle, mounted around the open bottom of the cylindrical disk for directing water flowing from the cylindrical disk of the valve into an opening in a clogged pipe and having an interior surface.

2. The hydraulic plumber's friend as claimed in claim 1, wherein the piston further has
multiple annular grooves defined around the cylindrical surface of the piston; and
multiple O-rings mounted respectively in the annular grooves and abutting the cylindrical body.

3. The hydraulic plumber's friend as claimed in claim 1, wherein the tapered end cap further has an extended rim being cylindrical, connecting to and extending up from the outer edge of the transverse partition of the tapered end cap and pressing against the cylindrical body.

4. The hydraulic plumber's friend as claimed in claim 1, wherein
the transverse partition of the tapered end cap further has
two curved inner tabs formed on the outer surface of the transverse partition, extending down from the inner edge of the keyed hole and forming two keyways, each curved inner tab having two ends, and the keyways formed respectively between corresponding ends of the curved inner tabs; and
a spring flange formed on and extending down from the outer surface of the transverse partition coaxially around the curved inner tabs and forming a spring mounting groove between the spring flange and the curved inner tabs; and
the proximal end of the spring pressing against the outer surface of the transverse partition is mounted in the spring mounting groove.

5. The hydraulic plumber's friend as claimed in claim 1, wherein
the stabilizer further has a nipple formed coaxially on the top of the stabilizer and having
a center;
an outer surface; and
an external thread formed on the outer surface of the nipple;
the axial hole formed through the center of the stabilizer is formed through the center of the nipple; and
the drive shaft further has an inner thread formed on the inside surface at the proximal end of the drive shaft and screwing onto the outer thread on the nipple of the stabilizer.

6. The hydraulic plumber's friend as claimed in claim 1, wherein
the cylindrical disk of the valve further has an annular groove defined in the outer surface of the cylindrical sidewall around the cylindrical sidewall between the charging holes and the closed top of the cylindrical disk; and
the valve further has an O-ring mounted in the annular groove in the cylindrical disk for forming a watertight seal between the cylindrical disk and the spout to prevent water from leaking out of the tapered end cap.

7. The hydraulic plumber's friend as claimed in claim 1, wherein the cylindrical body further has a notch defined in the top edge of the cylindrical body.

8. The hydraulic plumber's friend as claimed in claim 1, wherein the compression assembly further has a knob attached to the distal end of the drive shaft.

9. The hydraulic plumber's friend as claimed in claim 1, wherein the nozzle further has a mounting shoulder defined on the interior surface of the discharge hole and abutting the open bottom of the cylindrical disk.

10. The hydraulic plumber's friend as claimed in claim 1, wherein the nozzle further has a splash shield formed around and extending out and down from the exterior surface of the nozzle.

11. The hydraulic plumber's friend as claimed in claim 2, wherein the nozzle head further has a splash shield formed around and extending out and down from the exterior surface of the nozzle.

12. The hydraulic plumber's friend as claimed in claim 3, wherein the nozzle head further has a splash shield formed around and extending out and down from the exterior surface of the nozzle.

13. The hydraulic plumber's friend as claimed in claim 4, wherein the nozzle head further has a splash shield formed around and extending out and down from the exterior surface of the nozzle.

14. The hydraulic plumber's friend as claimed in claim 5, wherein the nozzle head further has a splash shield formed around and extending out and down from the exterior surface of the nozzle.

15. The hydraulic plumber's friend as claimed in claim 6, wherein the nozzle head further has a splash shield formed around and extending out and down from the exterior surface of the nozzle.

16. The hydraulic plumber's friend as claimed in claim 7, wherein the nozzle head further has a splash shield formed around and extending out and down from the exterior surface of the nozzle.

17. The hydraulic plumber's friend as claimed in claim 8, wherein the nozzle head further has a splash shield formed around and extending out and down from the exterior surface of the nozzle.

18. The hydraulic plumber's friend as claimed in claim 9, wherein the nozzle head further has a splash shield formed around and extending out and down from the exterior surface of the nozzle.

* * * * *